US007225852B2

(12) United States Patent
McConnell et al.

(10) Patent No.: US 7,225,852 B2
(45) Date of Patent: Jun. 5, 2007

(54) COVERED PAD FOR WALL PANEL AND MANUFACTURING PROCESS

(75) Inventors: Anthony McConnell, Holland, MI (US); Randolph Woellper, Hudsonville, MI (US); Harold R. Wilson, Hudsonville, MI (US)

(73) Assignee: Haworth, Inc., Holland, MI (US)

( * ) Notice: Subject to any disclaimer, the term of this patent is extended or adjusted under 35 U.S.C. 154(b) by 344 days.

(21) Appl. No.: 10/739,641

(22) Filed: Dec. 18, 2003

(65) Prior Publication Data

US 2005/0150616 A1 Jul. 14, 2005

(51) Int. Cl.
*A47G 5/00* (2006.01)

(52) U.S. Cl. ..... 160/351; 160/371; 160/236; 52/797.1; 52/800.11; 52/800.12; 52/481.2

(58) Field of Classification Search ..... 160/351, 160/135, 327, 328, 371; 52/145, 796.1, 797.1, 52/800.1, 800.11, 800.12, 481.2, 796.12
See application file for complete search history.

(56) References Cited

U.S. PATENT DOCUMENTS 5,129,202 A 7/1992 Payne et al.
5,172,530 A 12/1992 Fishel et al.
5,174,086 A 12/1992 Payne et al.
5,230,377 A * 7/1993 Berman ..... 160/327
5,423,151 A 6/1995 Caro et al.
6,202,381 B1 3/2001 Dame et al.
6,223,485 B1 5/2001 Beck et al.
6,226,849 B1 5/2001 Beck et al.
6,256,941 B1 7/2001 Yu et al.
6,393,783 B2 5/2002 Emaus et al.
6,619,003 B2 9/2003 Von Arx et al.
6,722,096 B2 4/2004 Von Arx et al.

* cited by examiner

*Primary Examiner*—Blair M. Johnson
(74) *Attorney, Agent, or Firm*—Flynn, Thiel, Boutell & Tanis, P.C.

(57) ABSTRACT

A cover pad for an upright wall having an improved support for simplifying attachment of a flexible covering such as fabric. The support includes a flat substrate sized to closely conform to the assembled cover pad. A ringlike frame defined by frame elements extend along edges of the substrate. Each frame element has a first elongate part engaged with the respective edge of the substrate, and a second elongate part joined to the first part by a lengthwise hinge. The second part functions as a hinging flange which is initially in an open position generally aligned with a front face of the substrate so that a flexible covering can be secured, as by adhesive, to an exposed surface of the flange while maintaining the fabric positioned across the face of the substrate. The hinging flanges of the frame elements are folded inwardly to overlie respective edges of the substrate, thereby securing the fabric across the face of the substrate and wrapped around the edges thereof.

22 Claims, 12 Drawing Sheets

COVERED PAD FOR WALL PANEL AND MANUFACTURING PROCESS

FIELD OF THE INVENTION

This invention relates to a cover pad for attachment to a wall, such as a frame of an upright space divider wall panel, and more specifically to an improved structure and manufacturing process for a covered pad.

BACKGROUND OF THE INVENTION

Interior space dividing wall systems as used in offices and the like typically incorporate a plurality of interconnected portable wall panels which often permit accessories such as work surfaces, storage units and other devices or structures to be mounted thereon. The wall panels generally include an interior upright frame which mounts, frequently releasably, cover pads or tiles on one or both sides thereof. The cover pads are typically provided with an outer cloth or fabric covering to provide the wall panel with a desirable appearance. Such cover pads require an internal supporting and rigidifying structure which may be defined by a rigid sheet of material such as formed metal, particle board, mineral board or the like, and/or an internal frame similar to an open picture frame. The internal structure of the pad then typically has the external face thereof covered with a thin sheet of flexible fabric or similar covering material. The flexible covering is also typically wrapped around the edges and corners of the internal structure. The covering is then secured by clips or adhesive to the internal structure.

Cover pads having constructions similar to those described above are well known, but as is well recognized in the industry, such pads possess structural and manufacturing complexities which cause the construction of such pads to be undesirably inefficient and costly, and which also result in the pads having a less than desirable appearance, particularly at the corners.

More specifically, the attachment of the flexible covering, i.e. the fabric, requires significant manual manipulation to effect aligning and stretching of the fabric across the exposed face of the internal structure. The wrapping and securing of the fabric around the edges is further complicated by the necessity of folding and inwardly tucking the excess fabric which exists at the corners. Such operations generally require significant manual handling of the fabric and often result in fabric wrapped corners of inconsistent quality and poor appearance. In addition, the internal structure often requires an undesired number of parts which increases manufacturing complexity and cost.

Accordingly, the present invention relates to improvements associated with cover pads, particularly for use on upright walls, which improvements simplify construction and manufacturing of the pad so as to overcome or at least minimize disadvantages associated with presently known cover pads.

More specifically, the cover pad of this invention provides an improved internal support for simplifying attachment of a flexible covering, i.e. a fabric. The internal support is of a hybrid construction in that it includes a flat plate-like substrate which is relatively rigid and is sized to closely conform to the size of the assembled cover pad. The plate-like substrate is enclosed within a ring-like frame defined by frame elements which extend along the respective edges of the substrate. Each frame element has a first elongate part which creates an engagement with the respective edge of the substrate, and a second elongate part which joins to the first part by a hinge, preferably a living hinge, which extends lengthwise of the frame element. The second part of the frame element functions as a swinging or hinging flange which is initially in an open position generally aligned with a flat front surface of the substrate so that a flexible fabric covering can be secured, as by an adhesive, to an exposed side surface of the flange while maintaining the fabric positioned across the front face of the substrate. The hinging flanges of the frame elements can then be folded, i.e. hinged, inwardly to overlie the respective edge of the substrate and create an engaged relationship with the respective first part of the frame member, thereby securing the fabric in position so that it extends tautly across the front face of the substrate and is also wrapped around all of the side edges thereof as defined by the frame elements, thereby providing the cover pad with a desired fabric-enclosed appearance.

In the improved cover pad of this invention, as aforesaid, the hinged flange part of the hinge portion of the frame element cooperates with the respective mounting part so as to define therebetween a clearance space which accommodates excess corner fabric material when the hinged part is moved into a closed or engaged position with the respective mounting part. The excess corner fabric material is inserted into this space during the closing or swinging of the hinge flanges of the frame elements so as to provide the cover pad with a fabric wrapped corner which has a consistent and desirable appearance.

The cover pad of the present invention, as aforesaid, preferably has the frame elements constructed of a plastics material which may comprise a dual extrusion so that the living hinge which extends lengthwise of the extruded frame element is of a flexible material relative to the material defining the first and second parts so as to permit hinging or swinging of the flange part through an angle of about 90° when the flange part is swingably moved from its normal open position during securement of the fabric thereto into its closed position wherein it overlies the edge of the substrate and creates an engaged relationship with the mounting part of the respective frame element. The mounting and hinging parts of the frame element are also preferably provided with cooperating latch structures which releasably couple the hinged part, when in the closed position, to the mounting part.

The improved cover pad of the present invention is believed to provide an improved structure by maintaining desirable structural integrity while at the same time permitting the pad to retain desirable properties with respect to sound absorption, acoustics, fire resistance and the like, and at the same time providing a cover pad which simplifies attachment of the fabric covering so that the resulting cover pad provides a relatively uniform appearance with respect to alignment of the fabric on the cover pad, and the folding of the fabric at the corners of the cover pad. In addition, this construction can be achieved in a manner which is believed to minimize the cost of materials, and which permits the construction of the cover pad to be partially or totally automated by minimizing manual manipulation and hence providing significant economy of manufacture.

Other objects and purposes of the invention will be apparent to persons familiar with constructions of this general type upon reading the following specification and inspecting the accompanying drawings.

BRIEF DESCRIPTION OF THE DRAWINGS

FIG. 11 illustrates the variation of FIG. 10 in its closed position, and additionally illustrates the manner in which the cover pad can be attached to an upright frame rail as associated with a wall panel or the like.

Figure 1:
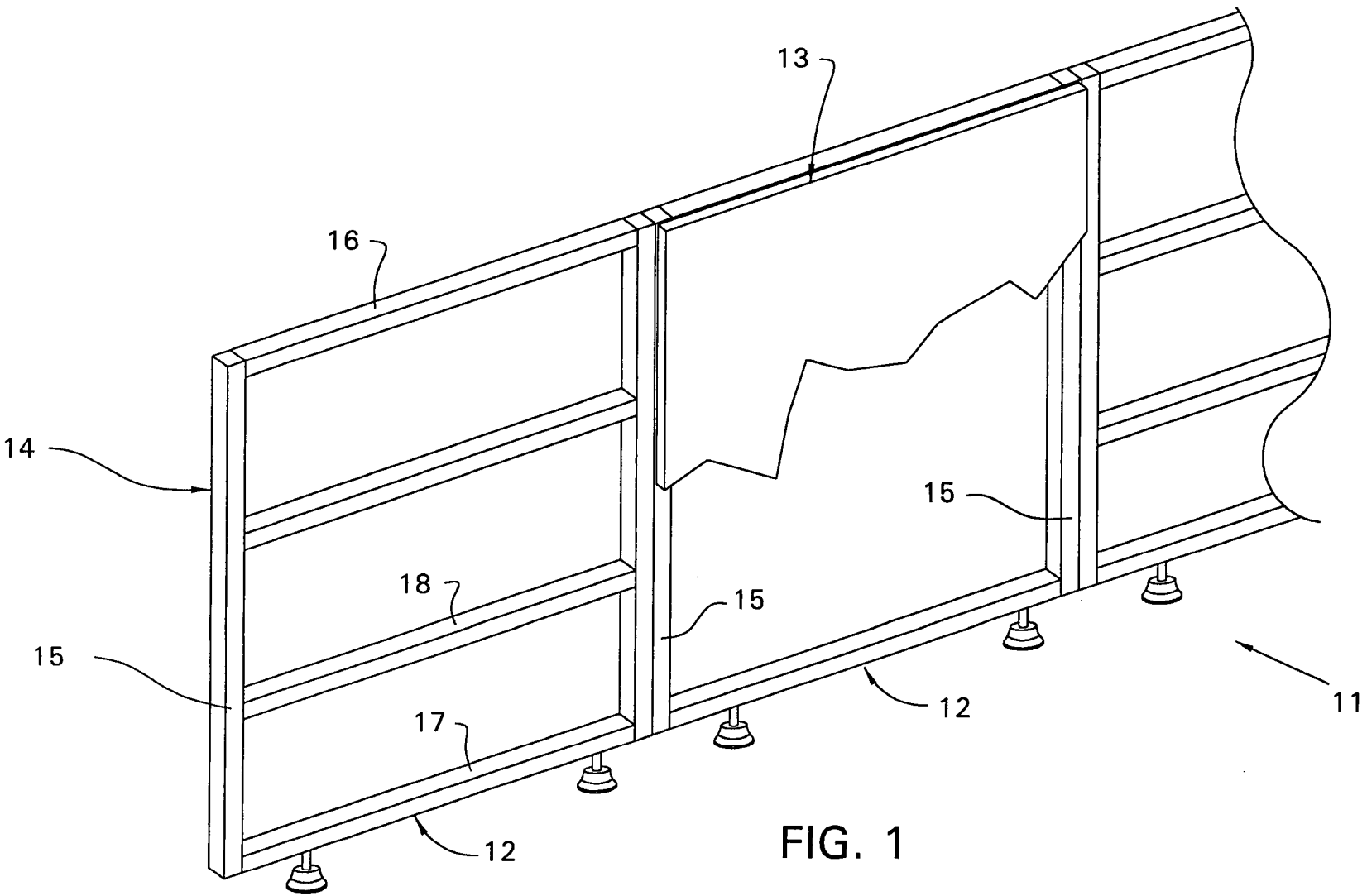
FIG. 1 is a perspective view of a known wall panel system having one or more cover pads associated with one and typically both sides thereof.

Certain terminology will be used in the following description for convenience and reference only, and will not be limiting. For example, the words "inwardly", "outwardly", "rightwardly" and "leftwardly" will refer to directions in the drawings to which reference is made. The word "front" will typically be used in relationship to that side of the cover pad which faces outwardly when mounted on a frame, whereas the word "rear" will refer to the opposite and typically non-visible side of the cover pad when mounted. Said terminology will include the words specifically mentioned, derivatives thereof, and words of similar import.

DETAILED DESCRIPTION

Figure 2:
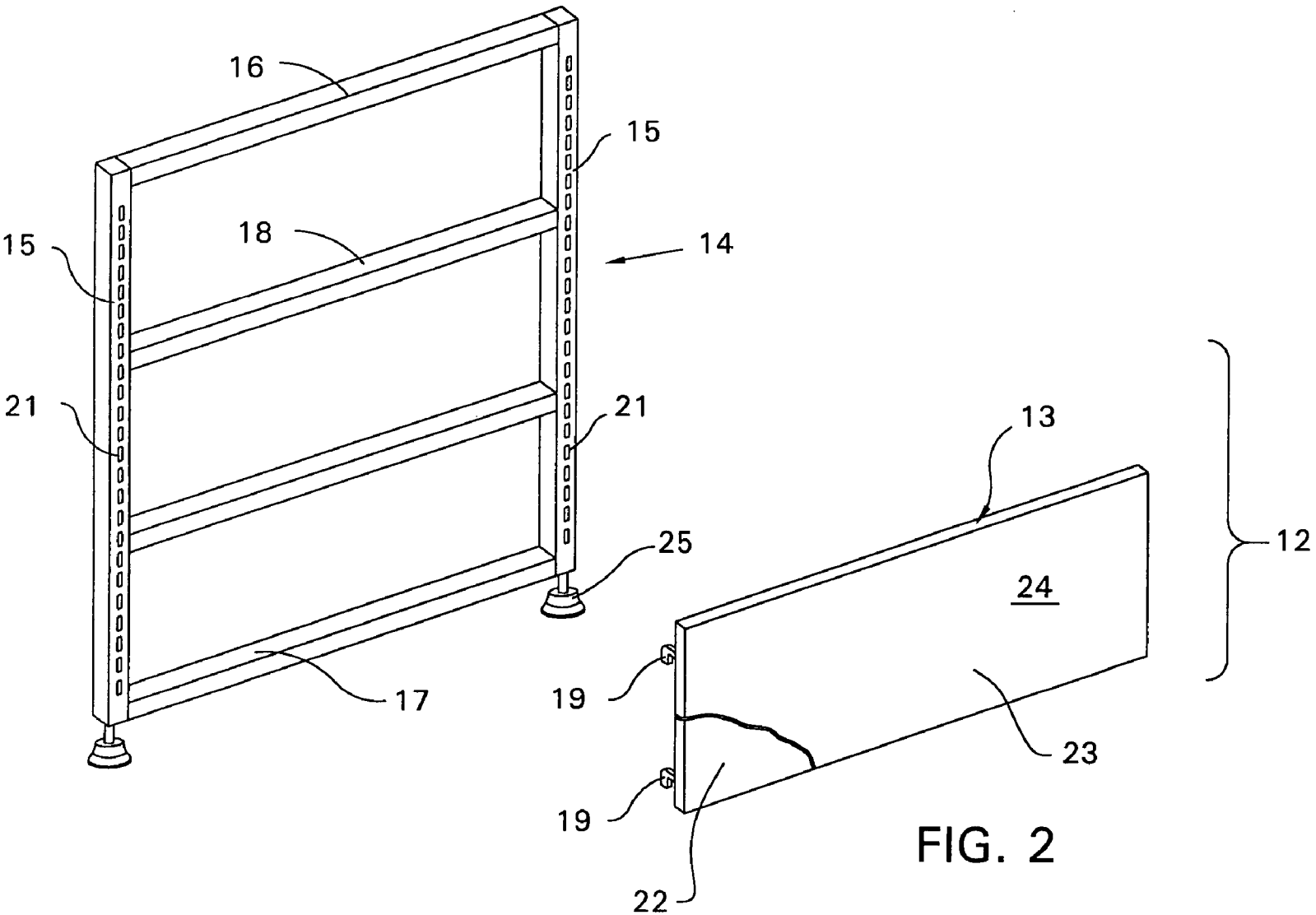
FIG. 2 is a perspective view which illustrates a typical internal frame of a known wall panel, and further illustrates a typical cover pad shown in a separated position relative to the panel frame.
Figure 3:
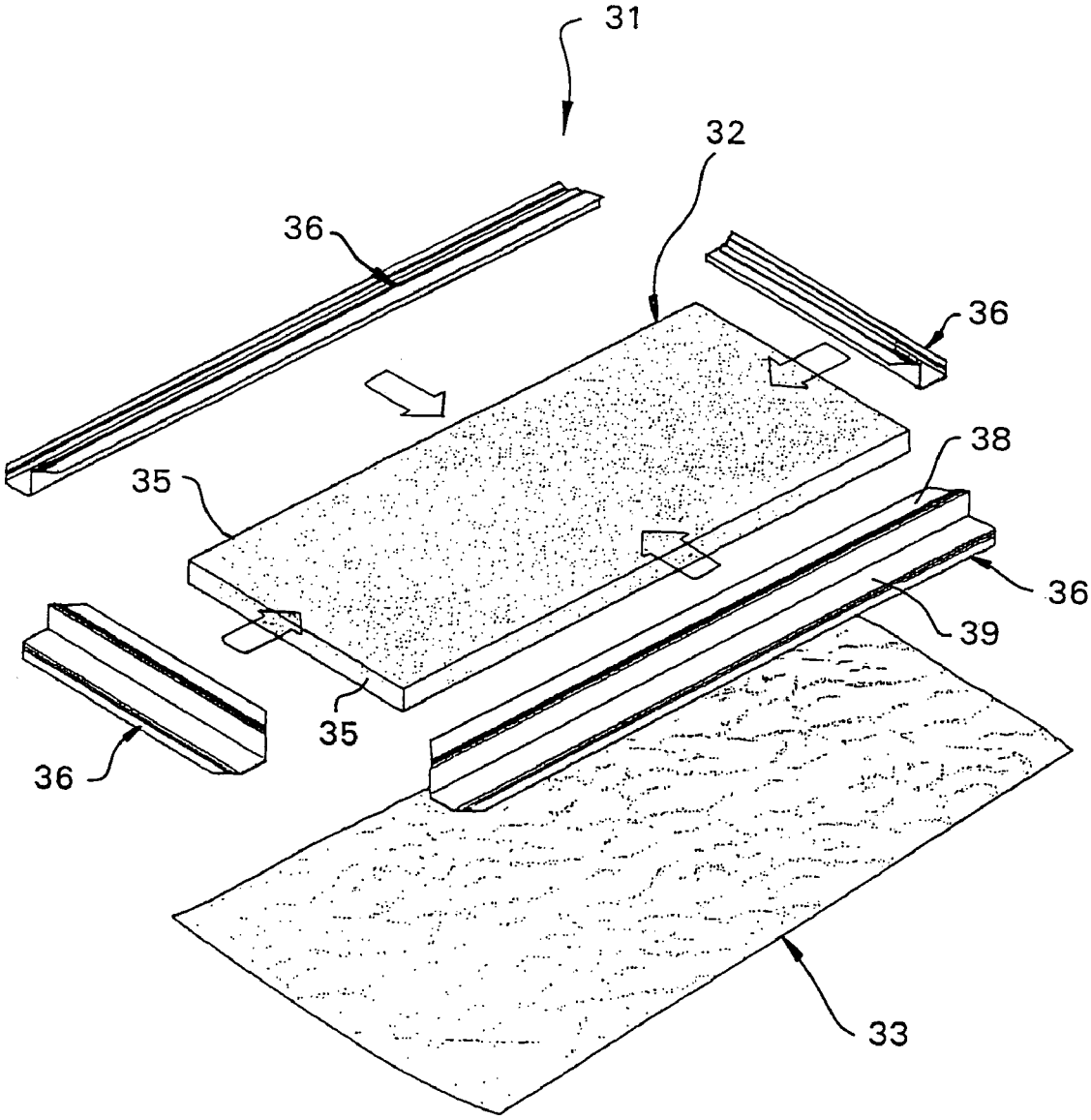
FIG. 3 is an exploded perspective view which illustrates the substrate, the frame elements defining the surrounding frame, and the flexible covering sheet which cooperate to define the cover pad according to a first variation of the invention.
Figure 4:
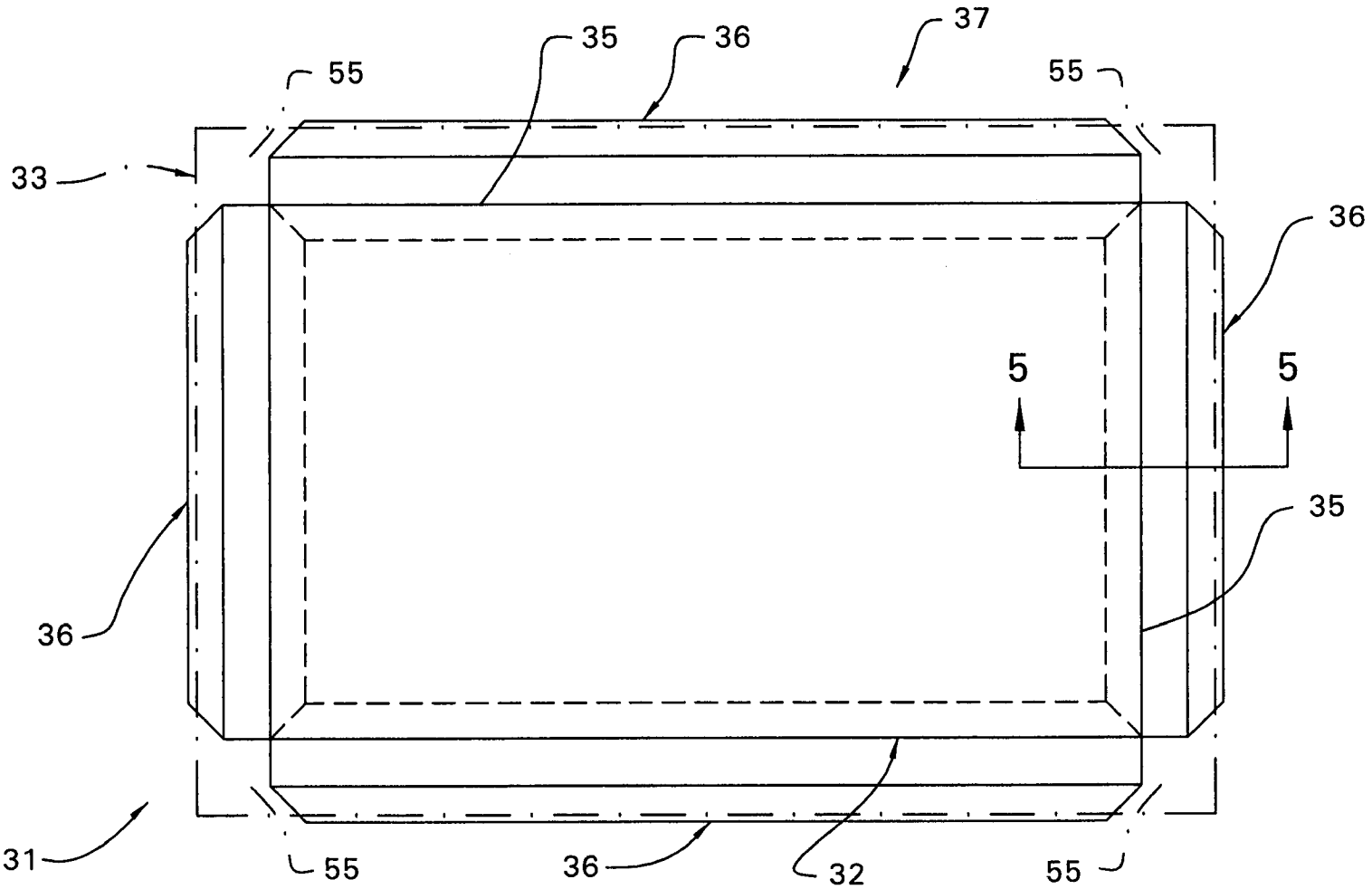
FIG. 4 is a front view showing the internal support structure of the cover pad of FIG. 3, which support structure is defined by a substrate having a frame therearound, with the frame elements shown in an open position prior to securement of the fabric covering.

Referring to FIGS. 1 and 2, there is illustrated part of an upright interior wall system 11 defined by a plurality of upright panels 12 which connect together horizontally in aligned and/or nonaligned relationship to define an upright wall for dividing interior spaces. Such wall systems 11 are conventionally utilized in offices and the like for dividing large interior spaces into smaller workspaces, and the wall system typically utilizes wall panels 12 which are factory or on-site assembled, and are supported on a conventional floor and project upwardly to a desired height which, in most use situations, is less than ceiling height.

In the illustrated arrangement, the wall panel 12 as depicted in FIG. 2 includes one or more cover pads or tiles 13 which mount on one or both sides of an interior rigid frame 14. The frame 14 conventionally includes a pair of parallel and sidewardly spaced elongate uprights or edge rails 15 which have the upper ends rigidly joined by a generally horizontally-extending top cross rail or beam 16, with a further horizontally-extending bottom cross rail or beam 17 being joined between the uprights 15 adjacent the lower ends thereof. The uprights 15 and beams 16-17 hence define a rigid upright frame of rectangular configuration which is open in the interior thereof and which, in many applications, is provided with one or more intermediate horizontally-extending cross rails or beams 18 disposed in vertically spaced but parallel relationship between the beams 16 and 17 and extending between and rigidly joined to the uprights 15.

The cover pads 13 conventionally employ some type of core, such as a board 22, which is covered by a flexible sheet-like covering 23, the front face 24 of which defines an exposed side of the wall panel.

The cover pads 13 are conventionally provided with some type of securing clips, such as hooks 19 illustrated in FIG. 2, which are releasably engagable with the frame 14 for permitting the cover tiles 13 to be attached to the exterior side surfaces of the frame. In one conventional technique the uprights 15 are provided with a plurality of slots 21 positioned within a row extending vertically, i.e. longitudinally, along the upright for permitting the hooks 19 to be engaged therein.

The frame also typically mounts adjustable feet or glides 25, which can be mounted to the lower ends of the uprights 15 if desired, for supportive engagement with the floor.

The overall panel system, and more specifically the wall panel construction described above, is conventional and illustrates one of many conventional systems with respect to the manner of constructing the panel frame and the attachment of the cover pads thereto.

Referring now to FIGS. 3-6, there is illustrated a first variation of a cover pad 31 according to the present invention, which cover pad is intended for attachment or association with a wall structure such as a portable prefabricated wall panel.

The cover pad 31 includes a core member or substrate 32 which is defined by a generally flat plate-like member constructed of a suitable material having sufficient strength and rigidity or stiffness so as to enable it to be surrounded by and attached to a ring-like frame 37, the later permitting edge portions of an enlarged but thin flexible sheet-like covering 33, typically a fabric sheet, to be engaged and secured thereto so that the fabric sheet extends in a flat and relatively taut condition across one side of the substrate 32 to hence define the enlarged front face 34 of the cover pad. The ring-like retainer frame 37 is defined by a plurality, here four, of elongate frame members 36 which attach to and extend along the respective side edges 35 of the substrate 32. The frame members 36 are all identical in cross-section, but will vary in length in accordance with the length of the respective side edge 35 with which the respective frame member 36 cooperates.

Each frame member 36 is elongated so as to extend generally along the length of a respective side edge 35 of the substrate 32, and includes two main parts which extend generally in parallel and elongated relationship with respect to one another, namely a mounting part 38 which is adapted for fixed securement or engagement with the substrate 32, and a covering or fabric securement part 39 which is hingedly joined to the mounting part 38 about an axis which extends lengthwise of the frame member so as to be swingable between an open position which permits attachment of the fabric layer 33 thereto, and a closed assembled position wherein the fabric layer 33 extends across the front face of the cover pad as well as around the side edges thereof.

The mounting part 38 in this variation of the frame member 36 is relatively rigid and generally L-shaped in cross-section and includes a generally flat intermediate or base wall 41 which substantially abuttingly contacts and overlies the side or edge wall 35 of the substrate 32. The base wall 41 along one edge thereof is rigidly joined to a further wall or flange 44 which extends in generally perpendicular relationship from the base wall 41. The flange 44 effectively overlies the rear surface 45 of the substrate 32 generally along the respective edge wall 35.

Figure 5:
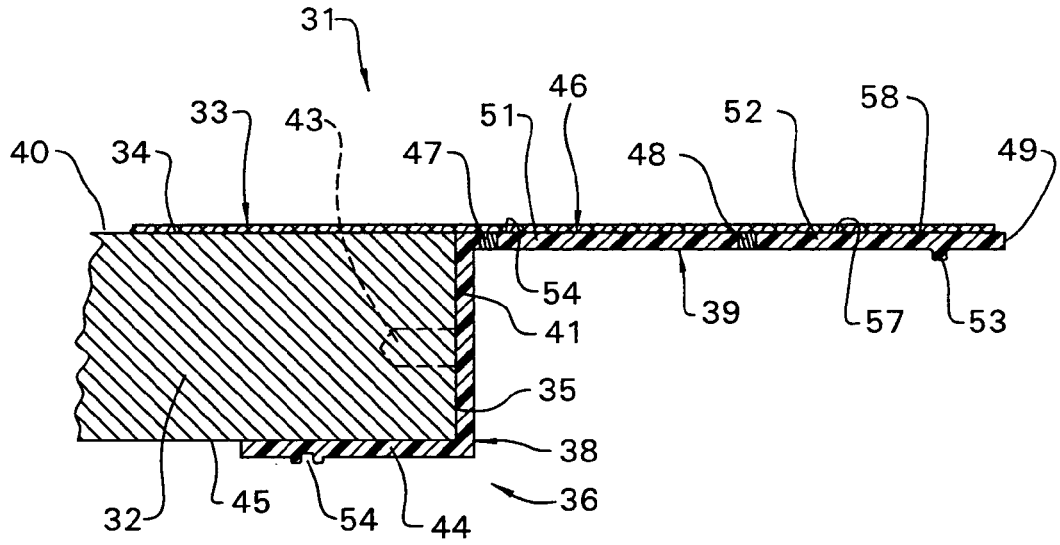
FIG. 5 is an enlarged sectional view taken generally along line 5-5 in FIG. 4 and showing the edge of the cover pad prior to closure of the hinged frame element.

The mounting part 38 is preferably fixedly attached to the substrate 32 using any one of several conventional fastening techniques. In the illustrated arrangement as shown in FIG. 5, for example, the base wall 41 can be provided with a fastener 43 integrally associated therewith, similar to a so-called Christmas tree fastener, the later being insertable into a suitable opening formed in the substrate 32 for fixedly securing the mounting part 38 to the substrate 32. Alternatively, separate securing structures such as screws can be utilized, or as a further alternative the mounting part 38 can be secured to the substrate 32 by means of a suitable adhesive or other bonding agent.

The elongate fabric retaining part 39 joins to the mounting part 38 generally adjacent the other edge of the base wall 41 so that the fabric retaining part 39 extends approximately coplanar with the front surface 40 of the substrate 32. The fabric retaining part 39 is defined principally by a generally flat flange 46 which extends lengthwise of the frame member and projects outwardly in generally cantilevered relationship from the base wall 41 so that the front or upper surface 57 thereof is substantially coplanar with the substrate front surface 40.

Flange 46 at one edge thereof is joined to the base wall 41 through a hinge 47 which is positioned in close proximity to the upper edge of the base wall 41 and which extends lengthwise throughout the length of the frame member 36. The hinge 47 defines an axis which is generally parallel with the respective adjacent side edge 35 of the substrate 32 and is positioned closely adjacent a corner defined between the front surface 40 and the respective side surface 35.

The top flange 46 has a further hinge 48 associated therewith, the later extending generally parallel with the hinge 47 but positioned outwardly in sidewardly spaced relation therefrom. Hinge 48 is positioned inwardly in sidewardly spaced relationship from the free end or edge 49 of the flange 46. The hinge 48 hence divides the top flange 46 into two relatively rigid parts, namely an inner flange part 51 with a width as defined between the hinges 47-48 which is similar to, but generally slightly greater than, the height of the base wall 41, and a second flange part 52 which projects outwardly from the hinge 48 so as to terminate at the free edge 49. The terminal flange part 52 has a catch part 53 associated therewith, such as protruding from the rear surface thereof, and this catch part 53 is adapted to engage a mating catch part 54 which is associated with the rear flange 44 when the fabric retaining flange 39 is hingedly moved into a closed fabric-retaining position illustrated in FIG. 6.

The frame member 36 is preferably formed as a one-piece, monolithic member constructed of a plastics material, preferably being a plastic co-extrusion profile. That is, the mounting part 38 and the flange parts 51 and 52 can be extruded of one type of plastics material so as to possess desired strength and rigidity, whereas the hinges 47 and 48 are extruded simultaneous with the flanges but of plastics material (typically a different plastics material) having different physical properties so as to have desired flexibility and bendability to enable them to function as living hinges while at the same time resulting in a one-piece and generally monolithic construction for the frame member.

The flexible fabric covering sheet 33 is positioned so as to overlie the upper substrate surface 40, and the sheet 33 is sized so that edge portions 58 thereof generally overlie the outer or upper face 57 of the flanges 46. The fabric edge portion 58, where it overlies the flange 46, is secured to the flange 46 by a suitable adhesive so that the fabric remains in a flat and generally taut condition as it extends over the front substrate face 40. The adhesive can also be applied directly between the fabric and the substrate face 40 if desired, although such is normally not required or preferred. In addition, a suitable cushioning and/or sound absorbing layer, such as fiberglass or flexible foam, can be positioned over the substrate front face 40 so as to be interposed between the substrate 32 and the fabric covering 33 if desired. Such intermediate layer would obviously overlie solely the substrate so as to not interfere with the adhesive securement of the fabric covering 33 to the flange 46.

Figure 6:
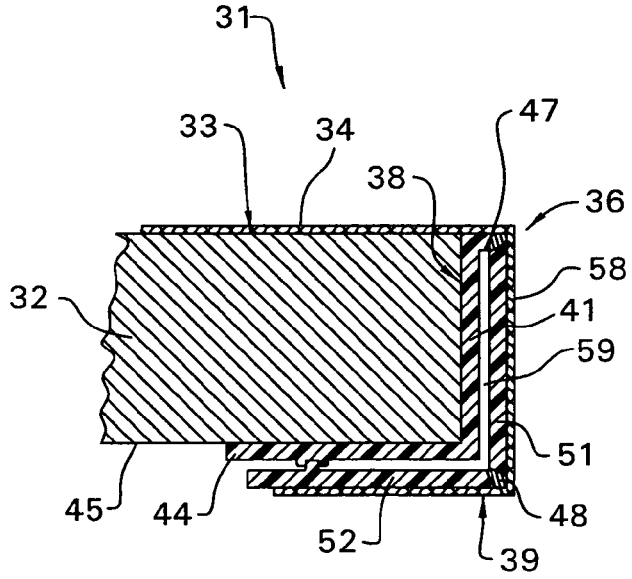
FIG. 6 is a view corresponding to FIG. 5 but showing the edge of the cover pad after closure of the hinged frame flange.

After the fabric 33 has been secured as discussed above, then the fabric retaining flange 39 as associated with each frame member 36 is swingably moved from the open position of FIG. 5 into the closed and assembled position of FIG. 6. Such swinging movement involves a hinging of the inner flange part 51 about the inner living hinge 47 through an angle of about 90° until the flange part 51 extends in generally parallel and overlying relationship to the base wall 41. Simultaneous or subsequent to the swinging of the flange part 51, the outer flange part 52 is also swingably moved relative to flange part 51 about the living hinge 48 through an angle of about 90° so that the outer flange part 52 moves into a position wherein it is generally parallel with and overlies the rear flange 44, in which position the catch part 53 can be engaged with the opposed catch part 54 to releasably but securely maintain the retaining flange part 39 in the assembled condition illustrated by FIG. 6. The catch defined by the opposed parts 53-54 can be of conventional and known construction so as to preferably create a resilient snap-type engagement to securely maintain the assembled condition of the frame member but which will permit release if desired, such as for permitting replacement of the fabric.

As illustrated by FIGS. 5 and 6, the living hinges 47 and 48 are preferably formed and positioned such that the retaining flange 39 when in the assembled condition illustrated in FIG. 6 is disposed so as to define a small clearance space 59 between the overlying frame parts 38 and 39. This space 59 enables excess fabric, namely the excess fabric 55 present at the corners of the sheet 33, to be tucked under the flanges 46 and folded into this clearance space 59 when the retaining flanges 46 are hingedly moved into the assembled or closed position illustrated by FIG. 6.

With the construction of the cover pad 31 illustrated in FIGS. 3-6 and as described above, the fabric sheet 33 can be maintained in a desirably flat and taut condition across the front face of the pad and at the same time the fabric is also wrapped around all of the side surfaces so that the pad 31, when mounted on a suitable supporting structure such as a panel frame, hence provides a pleasing and uniform appearance. At the same time the construction of the pad and the securement of the fabric thereto can be carried out employing efficient utilization of material, assembly labor and time. It will be appreciated that the pad 31 can be provided with conventional clips or hangers of any suitable configuration, such as hangers 19 as shown in FIG. 2, so as to permit the pad to be attached to a panel or wall frame.

Figure 7:
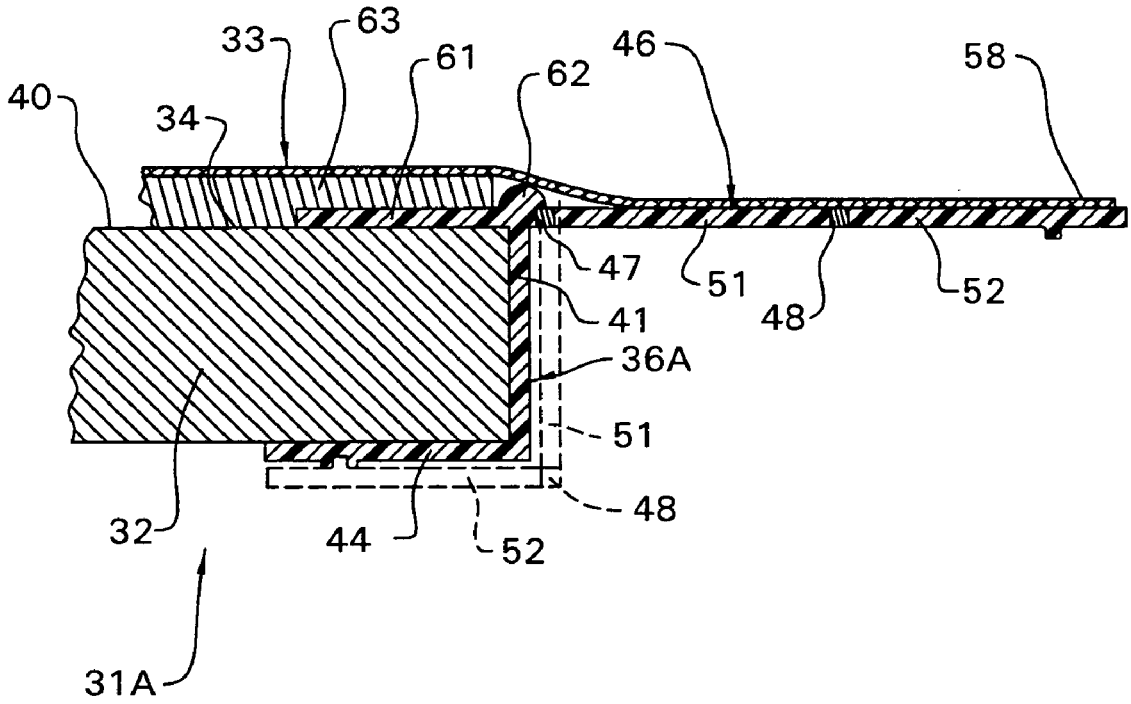
FIG. 7 is a view similar to FIG. 5 but illustrates a second variation of a hinged frame element which cooperates with the substrate for securement of the flexible fabric covering.

Referring now to FIG. 7, there is illustrated a second variation of a cover pad 31A according to the present invention. In this and subsequent variations, the same reference numbers are used to designate corresponding parts, except for addition of a distinguishing alphabetic designation, such as "A", added thereto.

The pad 31A utilizes therein a frame member 36A which incorporates all of the features associated with the frame member 36 described above relative to FIGS. 5 and 6. This modified frame member 36A, however, in addition includes a top or front flange part 61 which is rigidly joined to the front edge of the base wall 41 and protrudes inwardly so as to overlie the front substrate face 40. Flange 61 hence is cantilevered inwardly in generally parallel relationship to the rear flange 44, whereby flanges 44 and 61 together with base wall 41 provide the mounting part with a generally U- or channel-shaped cross-section which embraces the edge portion of the substrate 32. The frame member 36A additionally has a bead part 62 which protrudes outwardly from the front edge of the base wall 41, generally at its intersection with the top flange 61. This protruding bead part 62 preferably has a convex rounded exterior surface, and extends lengthwise along the frame member. In this variation the presence of the top flange 61 and the bead 62 enables a further layer 63, such as a layer of fiberglass or flexible foam, to be interposed between the substrate face 40 and the fabric sheet 33, and the protruding bead 62 provides a rounded retaining contour which confines the intermediate layer 63 therein while at the same time providing a rounded support for the fabric sheet 33 which passes thereover so as to be adhesively secured to the front face of the retaining flange 46. The modified frame member 36A of FIG. 7 in all other respects structurally and functionally corresponds to the arrangement of FIGS. 5-6 as described above.

Figure 8:
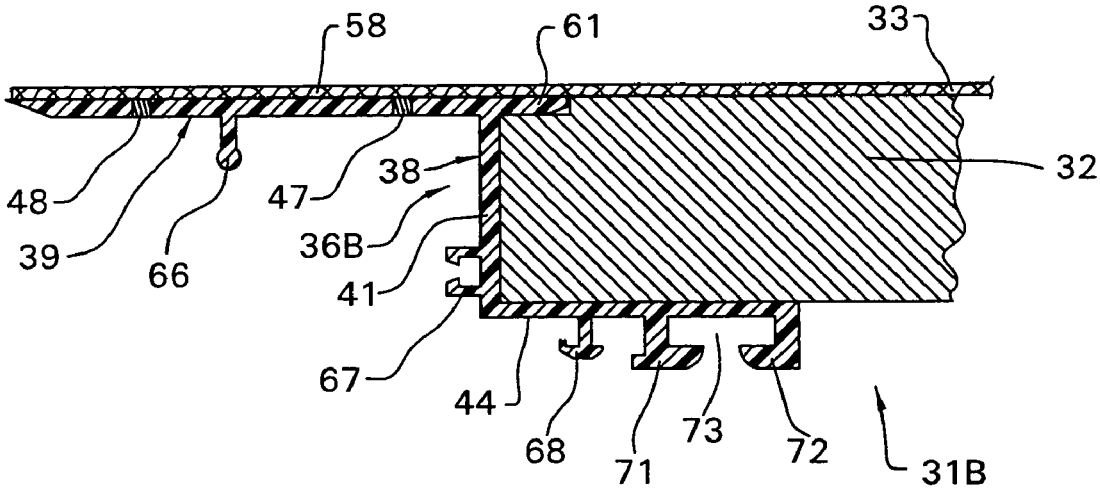
FIGS. 8 and 9 are fragmentary cross-sectional views which illustrate a third variation of the hinged frame element used for securing the flexible covering fabric to the substrate, with the frame element being respectively shown in the open and closed positions.
Figure 9:
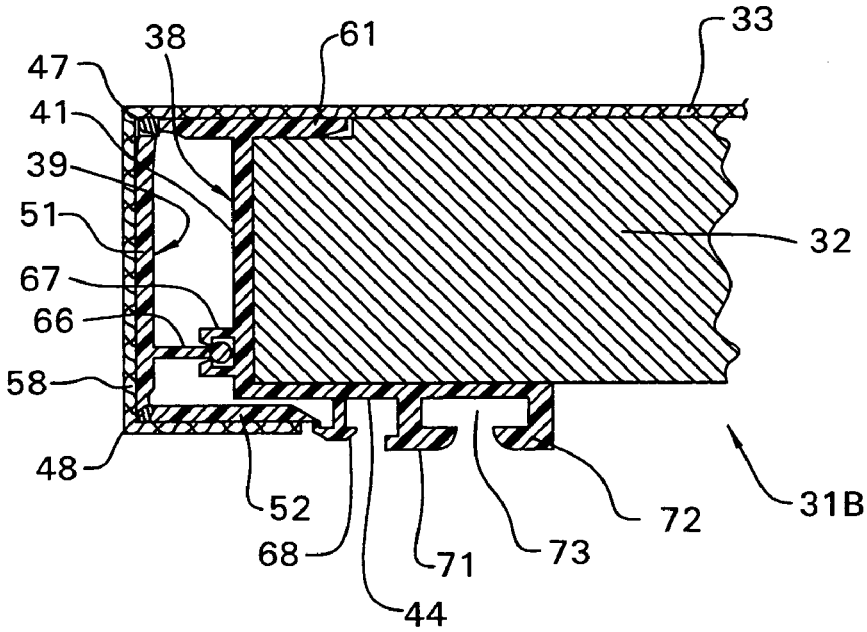

A third variation of a cover pad 31B is illustrated in FIGS. 8-9. This variation again includes a frame member 36B having mounting and retaining parts 38 and 39, with the retaining part 39 joined to the mounting part 38 through the first living hinge 47, and the retaining part having a further living hinge 48 associated therewith. In this variation, however, the inner flange 51 has a catch part 66 protruding therefrom, which catch part engages an opposed catch part 67 which protrudes from the base wall 41 to hence directly secure the flange part 51 to the base wall 41 when in the closed or assembled position.

In addition, the rear flange 44 has a catch part or rib 68 protruding outwardly therefrom, and the later is adapted to create a catch-type engaged relationship with the free edge of the terminal flange part 52 when the fabric retaining part 39 is in a folded and engaged relation with the mounting part 38. The mounting part 38 in this illustrated embodiment is also provided with a front flange 61 cantilevered inwardly to overlie the front surface of the substrate 62. The front face of the substrate 32 can be provided with a shallow recess along the corners thereof so as to accommodate the flange 61 therein and hence maintain a flat front face if desired. Flange 61 is optional and can be eliminated if desired consistent with the construction illustrated by FIGS. 5-6.

The rear flange 44 also protrudes inwardly a sufficient extent beyond the catch 68 so as to have an additional pair of ribs 71 and 72 protruding rearwardly therefrom, the later defining therebetween a rearwardly protruding groove 73 which extends lengthwise of the frame member. The groove 73 can be provided so as to permit the base portion of a suitable hook or other retaining member to be engaged therein, which hook or retaining member can be provided for securing the cover pad to a suitable wall or frame structure.

Figure 10:
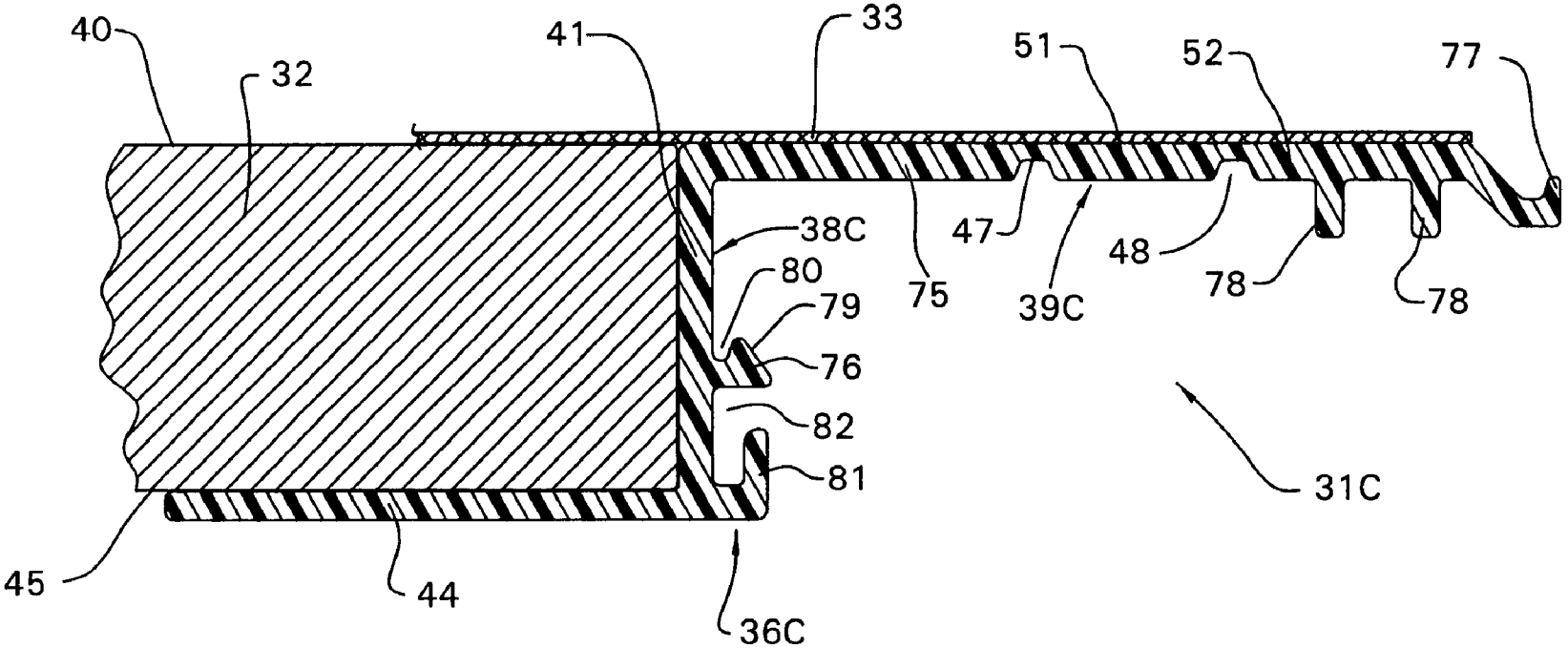
FIG. 10 is a fragmentary cross-sectional view showing a fourth variation of a hinged frame element associated with the substrate and shown in its open position.
Figure 11:
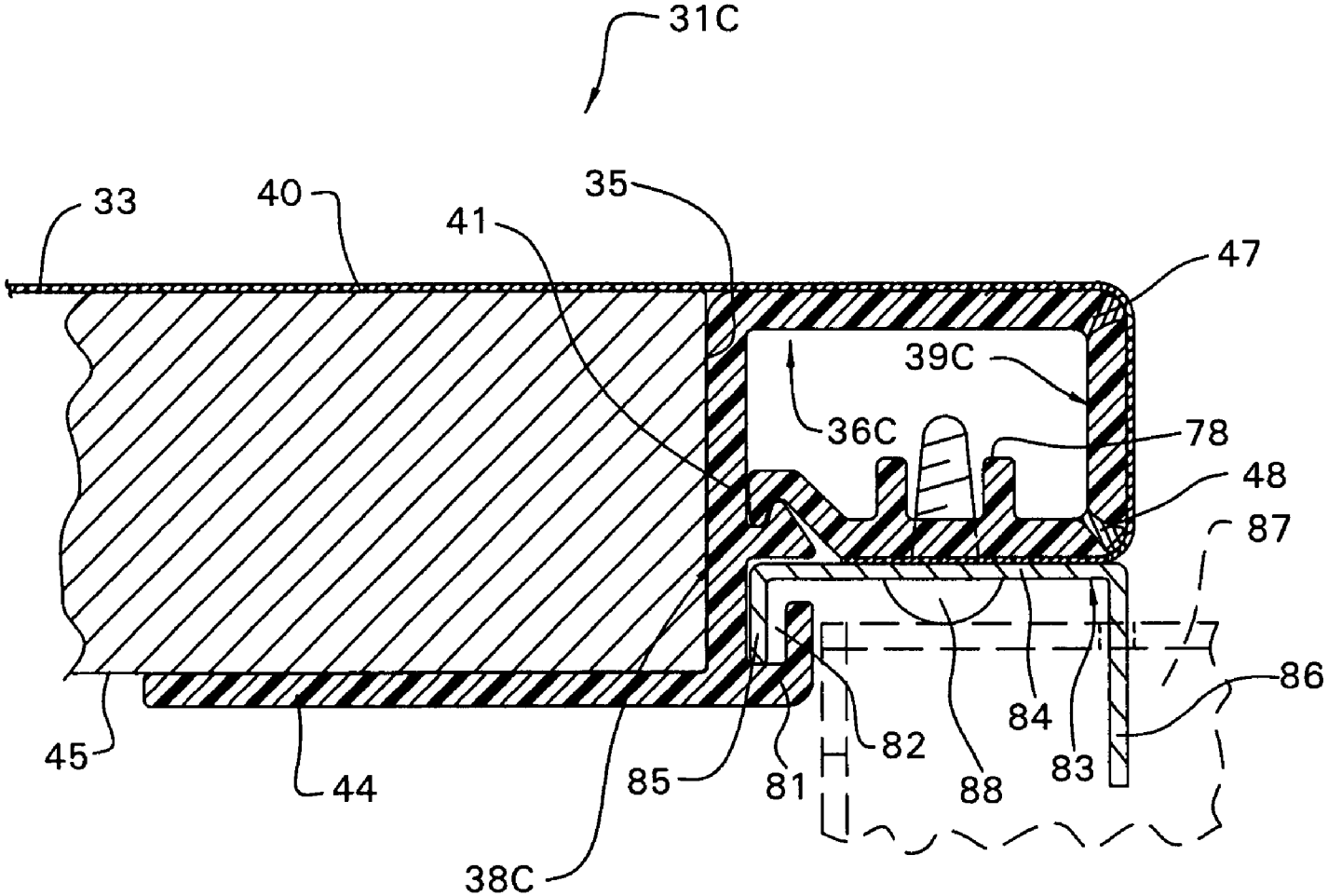

Referencing now FIGS. 10 and 11, there is illustrated a fourth variation of a cover pad 31C which utilizes a modified frame member 36C secured to each side edge of the substrate 32 to permit securement of the fabric covering 33. The modified frame member 36C, as explained in greater detail hereinafter, is constructed to provide a front-to-back thickness which is less than the front-to-back thickness of the substrate 32 such that the cover pad 31C, when mounted to horizontal and/or vertical frame rails associated with a wall panel or frame, can be disposed so that the substrate 32 is disposed so as to protrude partially into the interior of the wall panel frame.

The frame member 36C in this variation includes a mounting part 38C joined through the living hinge 47 to the foldable or hingeable fabric retention part 39C. The mounting part 38C again includes a base wall 41 which overlies the side edge 35 of the substrate 32, and a rear flange 44 which overlies the rear surface 45 of the substrate. The mounting part 38C in this embodiment, however, is generally Z-shaped in cross-section in that it also includes a front flange or wall 75 which is integrally and rigidly joined to the base wall 41 at the front edge thereof, and which projects transversely (i.e., perpendicularly) outwardly therefrom in generally coplanar relationship with the substrate front surface 40. This top flange 75 projects outwardly until terminating at the living hinge 47, whereby this later hinge 47 is hence disposed generally coplanar with the substrate top surface 40 but is spaced outwardly a substantial distance from the respectively adjacent side edge 35 when the mounting part 38C is secured to the substrate 32.

The retaining part 39C of the modified frame member 36C again includes flange parts 51 and 52 which are joined through the intermediate living hinge 48 with these flange parts 51 and 52 being disposed generally linearly aligned and cantilevered outwardly from the top flange 75 so as to also be substantially coplanar with the substrate top surface 40 when the retaining flange 39C is in the open position illustrated by FIG. 10.

The fabric sheet 33 when disposed over the substrate is sized and positioned so that the edge portions of the fabric sheet overlie and are adhesively secured to front surfaces defined by the flange parts 75, 51 and 52. The flange part 51, however, in this embodiment has a width as measured between the living hinges 47 and 48 which is less than the width of the base wall 41, which later width corresponds to the thickness of the substrate 32.

The retaining part 39C is foldable into the closed assembled position illustrated in FIG. 11 by initially folding the flange part 51 through an angle of approximately 90° about the living hinge 47, and by additionally relatively folding the flange part 52 relative to the flange part 51 through an angle of approximately 90° about the living hinge 48 so as to cause the flange parts 51 and 52 to assume positions which are generally approximately parallel with the respective walls 41 and 75, thereby defining a generally closed rectangular configuration. The retaining flange part 39B is maintained in the closed configuration by means of a catch or latch structure which includes a first generally L-shaped hook or latch part 77 which protrudes outwardly from the free end of the flange part 52 and which creates a releasable snap type latching engagement with a further latch part 76 which is cantilevered outwardly from the base wall 41. The catch part 76 is spaced forwardly from the rear substrate surface 45, and is provided with a forwardly sloped cam surface 79 thereon which cooperates with the leading end of the latch hook 77 during closure of the retaining flange 39C so as to permit the hook 77 to cam upwardly along the surface 79 and then resiliently snap into engagement within the recess or slot 80 defined by the hook-shaped latch part 76.

The flange part 52 in the illustrated embodiment also has a pair of generally parallel ribs 78 which protrude from the rearward side thereof and which extend lengthwise of the flange to provide for reinforcement thereof.

The mounting part 38C also has a generally L-shaped flange 81 associated therewith, which flange has a base leg which projects outwardly generally as an extension of the rear flange 44 and which then has a further leg which is cantilevered forwardly in generally parallel relationship to the base wall 41 so as to define a groove or slot 82 therebetween.

As illustrated by FIG. 11, the frame member 36C, when in the closed or assembled position, can have one or more hangers or clips 83 attached thereto for permitting the cover pad 31C to be attached to a panel frame, such as an upright frame rail 87 as indicated by dotted lines in FIG. 11. The hanger or clip 83 in the illustrated embodiment includes a base wall 84 which overlies the flange part 52 and which is fixedly secured thereto in an appropriate manner, such as by a screw-type fastener 88, the later being secured to the flange part 52 generally between the stiffening ribs 78. The clip 83 also has an edge flange 85 which protrudes into and is slidably guided within the slot 82 defined by the flange 81. Clip 83 also has a further flange 86 protruding rearwardly therefrom, the later typically having a hook-shaped configuration to enable it to be engaged within vertical slots associated with the front wall of the frame rail 87, such being conventional and well known (and as illustrated in FIG. 2). Since the profile (i.e., front-to-back thickness) of the assembled frame member 36C, as measured between the flanges 52 and 75 illustrated in FIG. 11, is less than the profile or thickness of the substrate 32, the clearance space provided rearwardly of the flange part 52 enables the frame rail 87 to protrude therein, whereby a portion of the cover pad thickness is hence disposed rearwardly of the front face of the frame rail 87, thereby minimizing the profile (i.e., thickness) of the cover pad which protrudes forwardly from the support frame, and hence minimizing the overall wall panel thickness.

Figure 12:
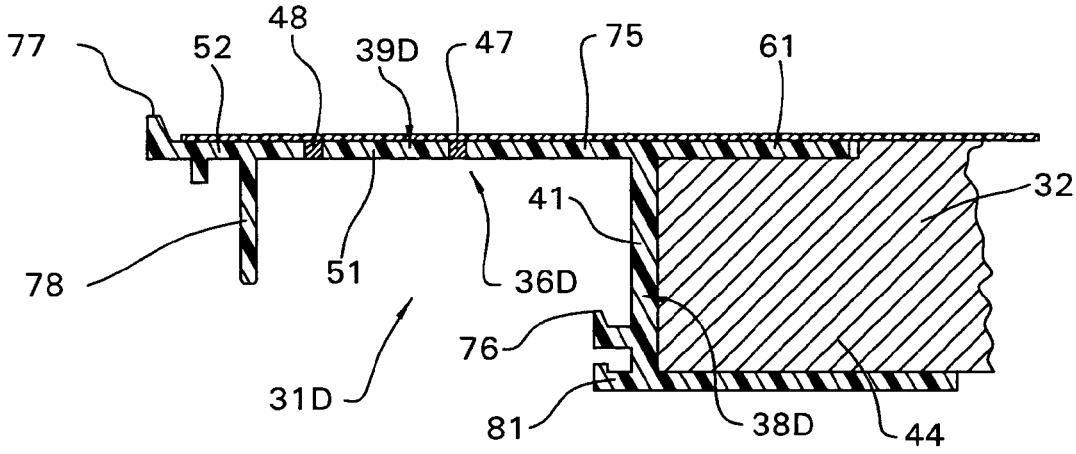
FIGS. 12 and 13 are views showing a fifth variation of a hinged frame element in the respective open and closed positions and associated with a substrate for permitting securement of a flexible fabric covering.
Figure 13:
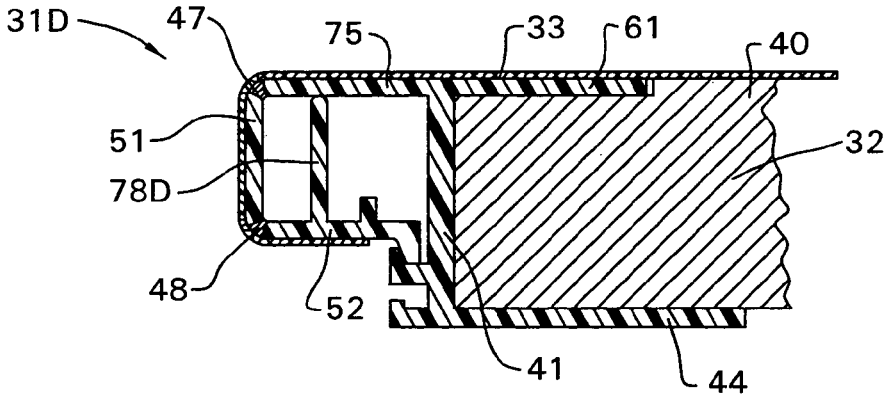

A fifth variation of a cover pad 31D is illustrated in FIGS. 12-13. This variation employs a modified frame member 36D which generally corresponds to the frame member 36C of FIGS. 11-12 except that the rib 78D associated with flange part 52 is cantilevered outwardly through a further extent such that the free edge of rib 78D is adapted to supportingly contact the rear surface of front flange 75 when the frame member 36D is in the closed or assembled position as illustrated by FIG. 13. This modified frame member 36D otherwise structurally and functionally corresponds to the frame member 36C described above, and again results in the frame having a reduced thickness or profile relative to the substrate 32 so as to enable the cover pad to be partially recessed into the interior of the wall panel frame to hence reduce the overall wall panel thickness.

Figure 14:
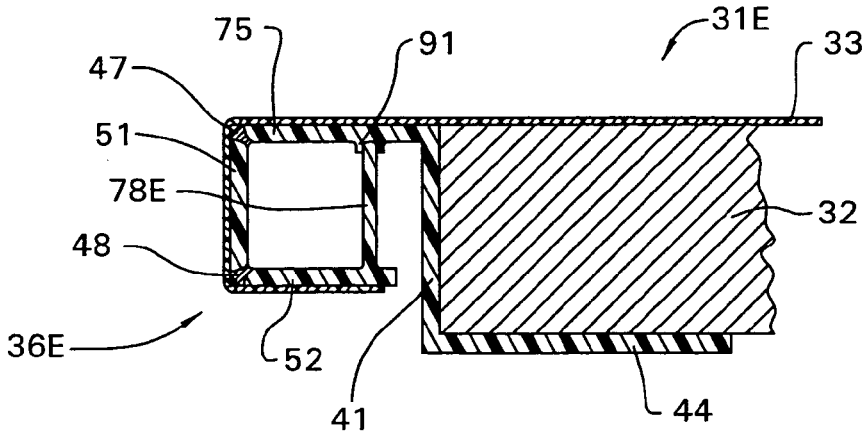
FIG. 14 is a view similar to FIG. 13 but illustrating a sixth variation of the hinged frame element.

Referencing now FIG. 14, there is illustrated a sixth variation of the frame member 36E which is structurally and functionally similar to the frame member 36D illustrated in FIGS. 12-13. However, the cantilevered rib 78E associated with the flange part 52 has a catch part defined on the free edge thereof, which catch part cooperates and releasably engages a cooperating catch part 92 defined on the rear of the front flange 75 so as to retain the frame member 36E in the closed assembled position shown in FIG. 14.

If desired, depending upon the desired front surface of the assembled cover pad, the frame members 36D and 36E can be provided with a front flange 61 (FIGS. 12 and 13) disposed for overlying the front substrate surface 40 if desired, or alternatively such front flange can be eliminated if not needed, such as illustrated by the arrangement of FIG. 14.

Figure 15:
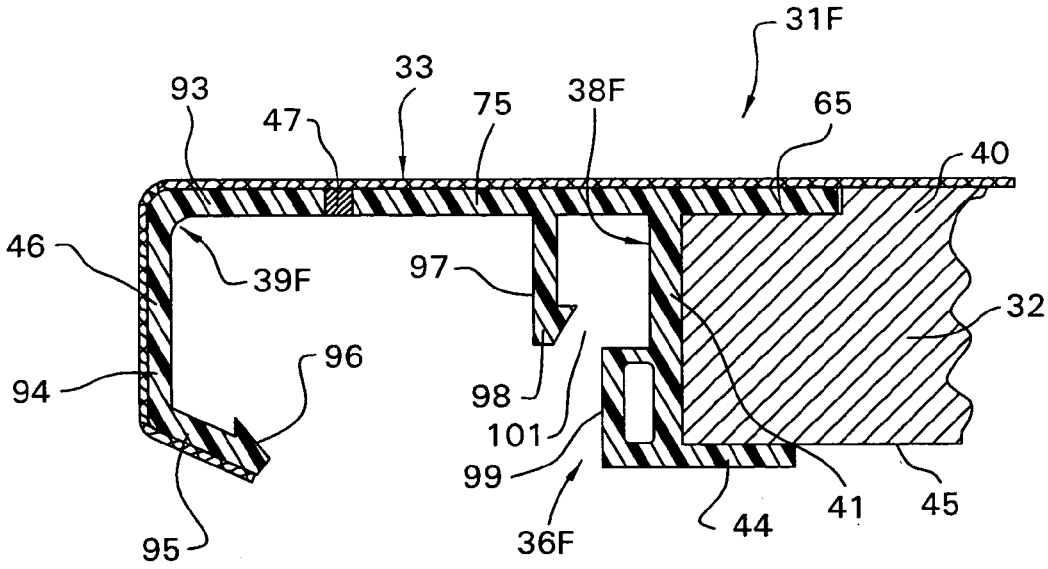
FIGS. 15 and 16 illustrate a seventh variation of a hinged frame element associated with the substrate and shown in the respective open and closed positions.
Figure 16:
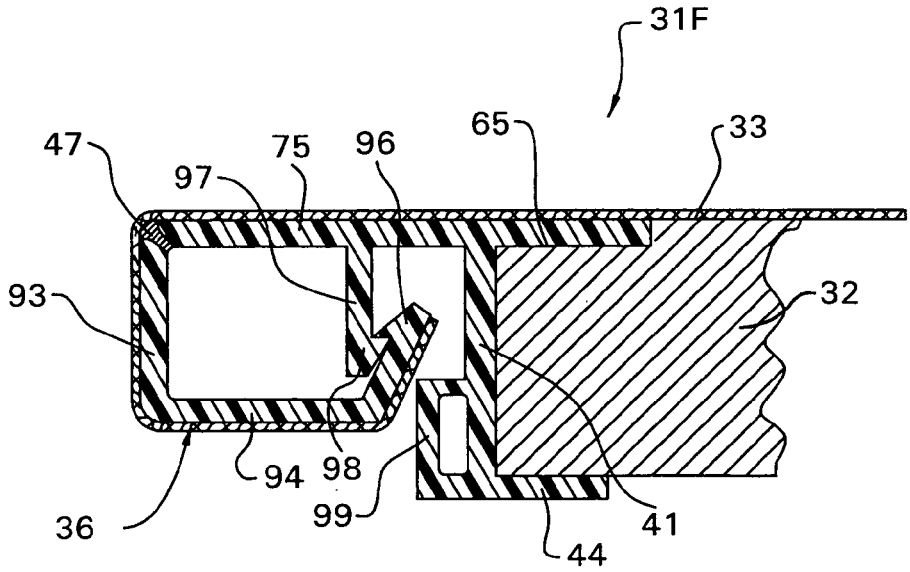

In FIGS. 15-16, there is illustrated a seventh embodiment of a cover pad 31F which utilizes a modified frame member 36F for attachment along each of the side edges of the substrate 32. The modified frame member 36F again includes a mounting part 38F which fixes to the edge of the substrate 32 and which couples through a living hinge 47 to the fabric retaining part 39F. The frame member 36F includes only the single living hinge 47 which couples the retaining part 39F to the mounting part 38F, with the retaining part 39F being moveable from the open position in FIG. 15 into the assembled closed position of FIG. 16, in which position the retaining part 39F is latched so as to define the frame member with an outer rectangular configuration having a profile or thickness less than the profile or thickness of the substrate 32.

The mounting part 38F associated with this embodiment again has a top flange 75 which projects outwardly generally coplanar with the front face of the substrate 32, which front flange 75 in the illustrated embodiment is effectively an extension of the front flange 65, although this later flange can be eliminated if desired, in which case the front flange 75 would have its upper surface positioned substantially coplanar with the substrate front surface 40. The top flange 75 has a catch flange 97 cantilevered transversely away from the rear surface thereof, which catch flange adjacent its free edge defines thereon a tapered hook end 98. This later hook end 98 is positioned adjacent but sidewardly spaced from a sideward protrusion 99 which is fixed to the base wall 41, thereby defining a narrow clearance slot 101 therebetween.

The retaining part 39F is formed generally as a U- or channel-shaped member defined by a top flange part 93 which at its inner edge is joined to the living hinge 47 and at its outer edge is joined through an integral rounded corner to an intermediate flange part 94, the later projecting transversely from the flange part 93. The flange part 94 in turn is integrally joined through a rounded corner to a further flange part 95 which projects inwardly toward the substrate 32 but which, in this embodiment, is positioned so that it is cantilevered in an angled diverging relationship relative to the front flange part 93. The rear flange part 95 functions generally as a latching flange and is provided with a tapered latch hook or catch 96 adjacent the free edge thereof.

With the frame member 36F in the unassembled open position illustrated by FIG. 15, the fabric covering 33 is positioned so as to extend across the substrate and also along the front substantially coplanar front surfaces of the flanges 75 and 93 and hence across the living hinge 47. The fabric covering 33 is then wrapped around the corner so as to extend over the intermediate flange part 94, and thereafter wraps around the corner so as to overlie the outer surface of the rear flange 95. The fabric covering will normally have its free edge disposed in the vicinity of the terminal end of the rear flange 95. The fabric covering 33 is secured, as by an adhesive, to the exterior surfaces of all of the flanges 75, 93, 94 and 95.

When the fabric is attached to the exterior surfaces of the frame member 36F as illustrated in FIG. 15, then the retaining part 39F is swingably hinged downwardly and inwardly about the living hinge 47 through an angle of about 90° so as to cause the latch part 95 and the hook 96 thereon to be swung upwardly into and then pushed through the slot 101 so as to effect a latching engagement between the hook parts 96 and 98 substantially as illustrated in FIG. 16. During insertion of the hook 96 into and through the slot 101, the opposed tapered surfaces on the hooks 96, 98 facilitate the inward sliding of the hook 96, and at the same time the cantilevered catch member 97 can resiliently deflect so as to allow the hook 96 to be inserted through the slot 101 and thereafter create a snap-like engagement with the hook 98.

In the various embodiments of the frame member as described above, which embodiments all have a mounting part which secures to an edge of the substrate and a retaining part joined through a hinge to the mounting part, it is preferred to construct the frame member as a co-extrusion so that the hinge will be of a suitable material having desired flexibility to enable it to function as a living hinge, whereas the remaining structure of the frame member will have greater rigidity (with typically only minimal flexibility) so as to enable the frame member to retain its desired shape and position. The embodiments which utilize a second living hinge 48 will permit formation of this hinge by co-extrusion of generally the same material utilized for forming the primary hinge 47. It is anticipated that the frame member can be manufactured as a PVC plastic co-extrusion.

While forming the living hinge associated with the frame member by means of a co-extrusion process as discussed above is a preferred construction, it will be appreciated that the frame member can be formed of a uniform plastics material, such as by extrusion or injection molding, and that the living hinge can be created by configuring the hinge section with a reduced cross-sectional thickness and appropriate shape, such as illustrated by the hinges 47-48 in FIG. 10. While it is recognized that living hinges of this latter type will not provide a large number of hinging cycles, nevertheless the construction of the present invention will not normally require the capability of providing a significant number of hinging cycles.

With the present invention, securement of the fabric to the cover panel structure can be simplified and automated so as to provide increased manufacturing efficiency and reduced manufacturing costs. For example, a pre-cut fabric sheet can be readily positioned and adhesively secured to the front surface of the frame and also to the front surface of the substrate if desired, such being facilitated by the fact that the frame, after its securement to the substrate, is in a generally open condition such that the front securing faces associated with the frame are all generally parallel and substantially coplanar with the front substrate face. Positioning and adhesively securing a pre-cut fabric sheet to the frame-substrate subassembly hence is simplified and can be either partially or fully automated. Thereafter the retaining flanges associated with the side frame members can be manually or automatically folded inwardly, with the fabric corners being simultaneously tucked interiorly of the frame members, whereby the retaining flanges are moved into closed positions so as to create a snap-type engagement and hence securement of the frame members in the closed assembled condition. The cover pad is hence fully assembled with the flexible covering maintained so as to be disposed in a taut overlying relationship with the front side of the substrate and also effectively and securely wrapped around the side edges of the substrate so as to provide a desirable appearance.

Various conventional manufacturing techniques can be utilized for effecting folding and hence closure of the retaining parts of the frame members.

The improved cover pads in addition permit the substrate to be manufactured from any one of several suitable but relatively inexpensive materials which are capable of providing the desired strength and structural integrity. Examples of material which are believed suitable for this purpose are mineral board, Fiberrock (sold by USG), R-board (sold by Atlas Corp.), hardboard, high density fiberglass, PET fiberboard, cellulosic fiberboard and other similar or equivalent materials. The material selected for the substrate 32 may also be determined based upon other desired properties such as sound absorption, fire resistance, etc.

As to the ring-like frame which is used for securement around the substrate, it will be appreciated that such frame may be defined by individual frame elements which are sized so as to correspond to the length of the respective side edges of the substrate. Alternatively, the frame may be formed as a continuous one-piece ring-like structure prior to receiving the substrate 32 therein if desired.

When the frame member is provided with a mounting part 38 having a U-shaped or channel configuration providing both front and rear flanges for engagement with the substrate 32, then this construction enables the channel member to be pushed onto the edge of the pre-cut substrate, with the frame members held in position on the substrate by friction. Permanent attachment is achieved subsequently in the process by bonding or adhesively securing the fabric to the frame members and the subsequent snap closure of the frame members to define the fabric-enclosed edges of the cover pad.

The fabric, in one embodiment of the invention, can be secured to the substrate and frame by means of a hot melt film which is positioned between the fabric and the substrate-frame subassembly, with the fabric and film being heated to effect desired securement of the fabric to the substrate-frame subassembly. The hinged sections of the frame members are thereafter folded over and the fabric corners tucked in to complete the cover pad assembly. The finished cover pad is then ready for subsequent handling, such as packaging and shipping.

Figure 17:
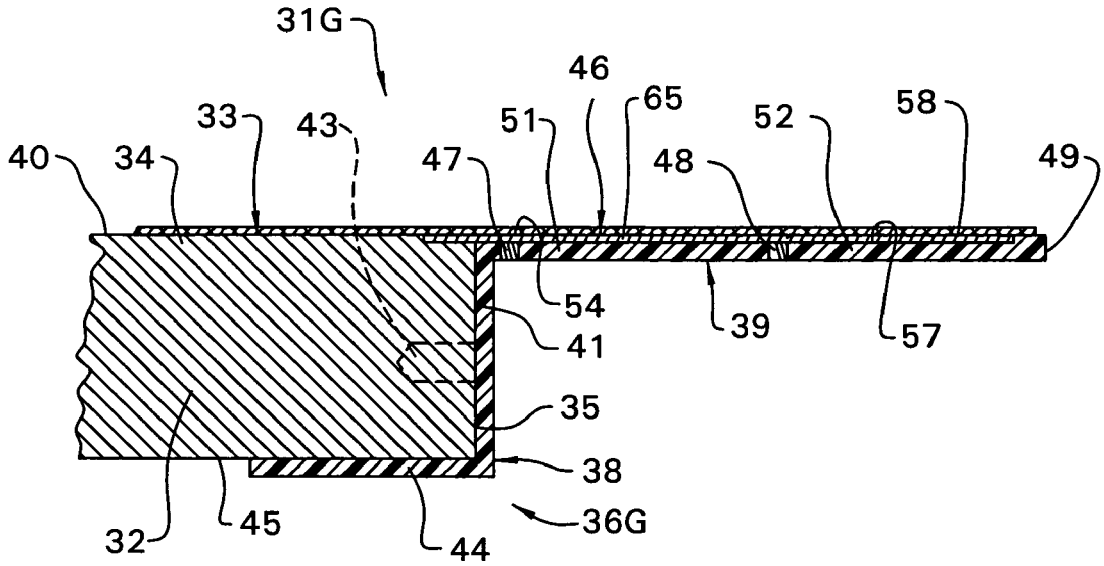
FIGS. 17 and 18 illustrate a further variation of the hinged frame element associated with the substrate and shown in the respective open and closed positions.
Figure 18:
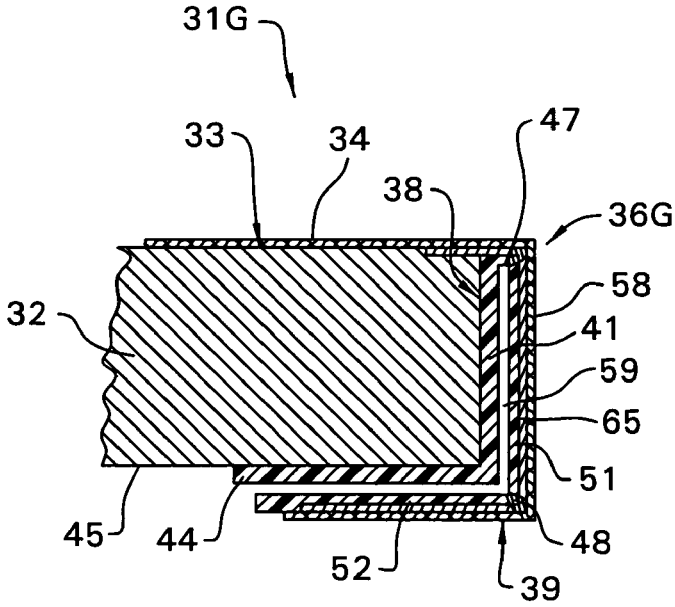

Referring now to FIGS. 17-18, there is illustrated a further variation of a cover pad 31G which utilizes a modified frame member 36G for attachment along each of the side edges of the substrate 32. The frame member 36G is, for convenience in illustration and explanation, constructed generally the same as the frame member 36 shown in FIGS. 5-6. The frame member 36G, however, is not provided with a catch cooperating between the flange and mounting parts for securing the frame member in a closed position. Rather, the flange 39 is provided with a retaining structure formed by a thin metal layer 65 (such as a thin aluminum sheet) which overlies the upper surface of the flange 39 and which specifically overlies the hinges 47 and 48. This thin metal layer 65 is laminated, for example adhesively secured, to the upper surface of the flange 39. The covering sheet 33 then is adhesively secured to the upper surface of this metal layer 65 and, when the flange 39 is folded downwardly into the closed assembled position shown by FIG. 18, the flange 39 hinges in the same manner as previously described, but the thin metal layer 65 undergoes bending (i.e., plastic deformation) and hence effectively assumes a permanent bent condition when the frame member 36G is moved into the closed position of FIG. 18. This deformation of the metal layer 65 is hence effective for retaining the flange in the closed assembled position of FIG. 18, whereby provision of a positive securing catch between the flange 39 and mounting element 38 can be eliminated.

Although particular preferred embodiments of the invention have been disclosed in detail for illustrative purposes, it will be recognized that variations or modifications of the disclosed apparatus, including the rearrangement of parts, lie within the scope of the present invention.

What is claimed is:

1. A cover pad adapted for mounting on an upright side of a frame for defining an exterior side surface of an upright interior wall, said cover pad comprising:

a main pad part having a length and width which are large relative to a thickness thereof, the main pad part defining thereon generally flat front and rear surfaces bounded by lengthwise and widthwise extending edges, the main pad part being bordered by peripheral edge surfaces which extend transversely between the edges associated with the front and rear surfaces;

a frame mounted on and extending around said main pad part, said frame being defined by elongate edge frame members which are positioned adjacent and extend along the peripheral edge surfaces of said main pad part;

said frame member including an elongate mounting element stationarily positioned adjacent a respective said peripheral edge surface of said main pad part;

said frame member also including an elongate covering retention element extending generally lengthwise of said mounting element and joined thereto through a first hinge which permits the covering retention element to be swingably moved transversely relative to the front surface of the main pad part between an open assembly position and a closed assembled position;

said frame member further including retaining structure for maintaining said covering retention element in said closed position so as to maintain said covering retention element in stationary engaged relationship with respect to said mounting element;

said covering retention element defining thereon an exterior engagement surface which is positioned outwardly from and approximately coplanar with the front surface of said main pad part when said covering retention element is in said open position;

said covering retention element including a first generally flat flange part which joins to said first hinge and which projects outwardly in approximately coplanar relationship with said front surface when said covering retention element is in said open position, said first flange part projecting transversely rearwardly relative to said front surface when in said closed position, said first flange part defining thereon a first portion of said exterior engagement surface;

said retention element including a second generally flat flange part which is joined to said first flange part through a second hinge which is sidewardly spaced from and extends generally parallel with said first hinge, said second flange part constituting a generally linear extension of said first flange part when said covering retention element is in said open position, said second flange part projecting transversely inwardly from the first flange part when in said closed position, said second flange part defining thereon a second part of said engagement surface; and a thin flexible sheet of covering material positioned to overlie said front surface of said main pad part and the exterior engagement surfaces on said frame members, said sheet being adhesively secured to said engagement surfaces so as to retain said sheet in a flat condition wherein it extends across the front surface of the main pad part, and portions of said flexible sheet as secured to said engagement surfaces defining finished side edges of said cover pad when said covering retention elements are in said closed position.

2. The cover pad according to claim 1, wherein said frame member is constructed in one piece of plastics material and defines a living hinge joining said mounting and covering retention elements.

3. The cover pad according to claim 2, wherein the mounting and covering retention elements and the living hinge joined therebetween are defined by a plastic coextrusion.

4. The cover pad according to claim 1, wherein said mounting element includes an L-shaped cross-sectional part which includes a base wall which substantially abuts the respective peripheral edge surface of the main pad part and a rear flange which substantially abuts the rear surface of the main pad part adjacent the edge thereof; and said covering retention element when in said open position being positioned outwardly relative to said base wall, and said hinge being positioned between said base wall and said covering retention element with said hinge being approximately coplanar with the front surface of said main pad part.

5. The cover pad according to claim 1, wherein said first hinge is positioned closely adjacent the edge of said front surface.

6. The cover pad according to claim 1, wherein said mounting element includes a base wall along the respective peripheral edge surface of the main pad part and a top flange which joins to the base wall in the vicinity of said front surface of said main pad part and protrudes outwardly therefrom in approximately coplanar relationship with said front surface, said hinge being joined between an outer edge of said top flange and said covering retention element whereby said hinge is spaced outwardly away from the respectively adjacent edge of said top surface.

7. The cover pad according to claim 1, wherein said frame member is a one-piece member constructed entirely of a plastics material and said hinges are each defined as a living hinge.

8. The cover pad according to claim 1, wherein said frame member is a plastics coextrusion so that said living hinge has physical properties which are different from the physical properties associated with the mounting and retention elements.

9. A cover pad adapted for mounting on an upright side of a frame for defining an exterior side surface of an upright interior wall, said cover pad comprising:

a main pad part having a length and width which are large relative to a thickness thereof, the main pad part defining thereon generally flat front and rear surfaces bounded by lengthwise and widthwise extending edges, the main pad part being bordered by peripheral edge surfaces which extend transversely between the edges associated with the front and rear surfaces;

a frame mounted on and extending around said main pad part, said frame being defined by elongate edge frame members which are positioned adjacent and extend along the peripheral edge surfaces of said main pad part;

said frame member including an elongate mounting element stationarily positioned adjacent a respective said peripheral edge surface of said main pad part;

said frame member also including an elongate covering retention element extending generally lengthwise of said mounting element and joined thereto through a hinge which permits the covering retention element to be swingably moved transversely relative to the front surface of the main pad part between an open assembly position and a closed assembled position;

said frame member further including retaining structure for maintaining said covering retention element in said closed position so as to maintain said covering retention element in stationary engaged relationship with respect to said mounting element;

said covering retention element defining thereon an exterior retention surface which is positioned outwardly from and approximately coplanar with the front surface of said main pad part when said covering retention element is in said open position, said retention surface being spaced outwardly from and positioned transversely relative to said front surface when said covering retention element is in said closed position;

a thin flexible sheet of covering material positioned to overlie said front surface of said main pad part and the retention surfaces on said frame members, said sheet being adhesively secured to said retention surfaces so as to retain said sheet in a flat condition wherein it extends across the front surface of the main pad part, and portions of said flexible sheet as secured to said retention surfaces defining finished side edges of said cover pad when said covering retention elements are in said closed position;

said covering retention element including a first flange part which, when the retention element is in said closed position, is joined to said hinge and projects transversely rearwardly relative to said front surface in outwardly spaced relation from the respectively adjacent peripheral edge surface of the main pad part;

said covering retention element also including a second flange part which, when the retention element is in said closed position, is joined to an opposite edge of said first flange part and projects inwardly toward the main pad part in rearwardly spaced relationship relative to said hinge;

said retaining structure including a cooperating part on said second flange part which is engaged with a cooperating part on said mounting element for latching said covering retention element in said closed position; and said first and second flange parts respectively defining thereon first and second exterior surfaces which define parts of said retention surface, and said covering sheet being engaged with and adhered to both of said first and second parts of said retention surface so that the covering sheet wraps around and encloses a side edge of the cover pad.

10. The cover pad according to claim 9, wherein the cooperating parts defined on the mounting and retention elements define a releasable snap-like latch.

11. The cover pad according to claim 9, wherein a thin layer of flexible material is positioned to overlie the front surface of the main pad part and is positionally retained between the front surface and the overlying covering sheet.

12. The cover pad according to claim 9, wherein a plurality of mounting elements are fixed mounted on the cover pad and protrude rearwardly therefrom for releasable engagement with said wall frame.

13. The cover pad according to claim 12, wherein a said mounting element is fixed to said cover pad adjacent each rear corner thereof.

14. A process for forming a covering pad adapted for attachment to an upright wall, comprising the steps of:

providing a relatively flat substrate having a length and width which are large relative to a thickness thereof, the substrate defining thereon front and rear surfaces, the substrate being bordered by edge surfaces which extend transversely between the front and rear surfaces;

providing an elongate side frame member having generally parallel and elongate mounting and folding elements joined through a first hinge extending in the elongated direction of the frame member;

positioning a said side frame member adjacent each said edge surface of said substrate so that the mounting element extends along the respective edge surface and the first hinge extends generally parallel with the respective edge surface, and the folding element projects outwardly away from the substrate in generally parallel and approximately coplanar relationship with the front surface thereof;

providing said folding element with first and second flange parts with said first flange part being joined along one edge thereof to said first hinge, and providing said folding element with a second hinge which extends parallel with said first hinge and which joins the other edge of said first flange part to said second flange part;

providing a thin and flexible sheet of covering material;

positioning the sheet of covering material so that it overlies the front surface of the substrate and front faces of said flanges associated with said folding elements;

adhesively securing the sheet of covering material to at least the front faces of said folding elements;

folding said folding elements about said first hinges transversely rearwardly away from said substrate front surface into a folded position wherein the front faces of said flanges and the covering material disposed thereover project transversely and define exterior side surfaces of said pad;

folding said second flange part transversely inwardly relative to said first flange part about said second hinge when said first flange part is folded transversely rearwardly about said first hinge so that said second flange part engages and secures to said mounting element to define said folded position; and retaining said folding elements in said folded position.

15. The process according to claim 14, including the step of providing said frame member as a plastic coextrusion with said first hinge being a living hinge extruded of a plastic material having different properties from the extruded plastic material defining said mounting and folding elements.

16. The process according to claim 15, including providing said frame member with cooperating latch parts which create a resilient snap latching of said folding element to said mounting element for retaining the folding elements in said folded position.

17. The process according to claim 14, including providing said mounting element with base and rear walls which extend in generally transverse relationship, and initially positioning said mounting element so that said base wall abuts the respective edge surface of the substrate and the rear wall overlies the rear surface of the substrate.

18. The process according to claim 14, including positioning said first hinge at a position which is approximately coplanar with the front surface of said substrate when the mounting element is properly positioned adjacent the respective edge surface.

19. The process according to claim 14, where the folding elements are retained in said folded position by securing the folded elements to the respective mounting elements.

20. A cover pad adapted for mounting on an upright side of a frame for defining an exterior side surface of an upright interior wall, said cover pad comprising:

a main pad part having a length and width which are large relative to a thickness thereof, the main pad part defining thereon generally flat front and rear surfaces bounded by lengthwise and widthwise extending edges, the main pad part being bordered by peripheral edge surfaces which extend transversely between the edges associated with the front and rear surfaces;

a frame mounted on and extending around said main pad part, said frame being defined by elongate edge frame members which are positioned adjacent and extend along the peripheral edge surfaces of said main pad part;

said frame member including an elongate mounting element stationarily positioned adjacent a respective said peripheral edge surface of said main pad part;

said frame member also including an elongate covering retention element extending generally lengthwise of said mounting element and joined thereto through a hinge which permits the covering retention element to be swingably moved transversely relative to the front surface of the main pad part between an open assembly position and a closed assembled position;

said covering retention element defining thereon an exterior retention surface which is positioned outwardly from and approximately coplanar with the front surface of said main pad part when said fabric retention element is in said open position, said retention surface being spaced outwardly from and positioned transversely relative to said front surface when said fabric retention element is in said closed position;

a thin flexible sheet of covering material positioned to overlie said front surface of said main pad part and the retention surfaces on said frame members, said sheet being adhesively secured to said retention surfaces so as to retain said sheet in a flat condition wherein it extends across the front surface of the main pad part, and portions of said flexible sheet as secured to said retention surfaces defining finished side edges of said cover pad when said covering retention elements are in said closed position;

said mounting element including a base wall which substantially abuts the respective peripheral edge of the main pad part and a top flange which joins to the base wall in the vicinity of said front surface of said main pad part and protrudes outwardly therefrom in approximately coplanar relationship with said front surface, said hinge being joined between an outer edge of said top flange and said covering retention element whereby said hinge is spaced outwardly away from the respectively adjacent edge of said top surface;

said covering retention element when in said closed position including a first flange part joined to said hinge and projecting transversely rearwardly relative to said front surface in outwardly spaced relation from the respectively adjacent peripheral edge surface of the main pad part;

said covering retention element also including a second flange part which, when the retention element is in said closed position, is joined adjacent an opposite edge of said first flange part and projects inwardly toward the main pad part in rearwardly spaced relationship relative to said hinge but in forwardly spaced relationship relative to the rear surface of said main pad part, said second flange part having a cooperating part thereon which is engaged with a cooperating part on said mounting element for latching said covering retention element in said closed position.

21. The cover pad according to claim 20, wherein said frame member is a one-piece member constructed entirely of a plastics material and said hinge is defined as a living hinge.

22. The cover pad according to claim 21, wherein said frame member is a plastics coextrusion so that said living hinge has physical properties which are different from the physical properties associated with the mounting and retention elements.

* * * * *